US006286523B1

(12) United States Patent
Wilson et al.

(10) Patent No.: US 6,286,523 B1
(45) Date of Patent: Sep. 11, 2001

(54) PARTS TRANSPORT MECHANISM FOR A ROTARY STYLE PARTS TREATING MACHINE

(75) Inventors: Karle M. Wilson, West Chester, OH (US); Jeffrey D. Bourgoin, Florence, KY (US)

(73) Assignee: CAE Ransohoff Inc., Cincinnati, OH (US)

( * ) Notice: Subject to any disclaimer, the term of this patent is extended or adjusted under 35 U.S.C. 154(b) by 0 days.

(21) Appl. No.: 09/491,057

(22) Filed: Jan. 25, 2000

(51) Int. Cl.[7] ..... B08B 3/02

(52) U.S. Cl. ..... 134/80; 134/140; 134/142; 134/153

(58) Field of Search ..... 134/79, 80, 81, 134/140, 142, 153, 158, 161, 162

(56) References Cited

U.S. PATENT DOCUMENTS

| | | | | |
|---|---|---|---|---|
| 97,688 | * | 12/1869 | Pfeiffer | 134/142 |
| 2,078,699 | * | 4/1937 | Taylor et al. | 134/81 |
| 2,823,682 | | 2/1958 | Coulter | 134/94 |
| 3,096,774 | | 7/1963 | Rand | 134/79 |
| 3,153,419 | | 10/1964 | Evans et al. | 134/133 |
| 3,192,935 | | 7/1965 | Hanifan | 134/142 |
| 3,240,216 | | 3/1966 | Sadwith | 134/80 |
| 3,645,791 | | 2/1972 | Sadwith | 134/25 A |
| 3,691,691 | | 9/1972 | Smith | 51/15 |
| 3,952,756 | | 4/1976 | Sheppard | 134/133 |
| 4,084,357 | | 4/1978 | Moses | 51/419 |
| 4,174,722 | | 11/1979 | Fleenor et al. | 134/62 |
| 4,215,928 | * | 8/1980 | Bayley et al. | 134/80 X |
| 4,516,523 | | 5/1985 | Knox | 118/500 |
| 4,577,441 | | 3/1986 | Brenner | 51/419 |
| 4,662,125 | | 5/1987 | Brenner et al. | 51/419 |
| 5,029,595 | | 7/1991 | Hautau | 134/142 |
| 5,197,500 | | 3/1993 | Diamond | 134/142 |
| 5,368,053 | | 11/1994 | Wilson | 134/95.2 |
| 5,653,247 | * | 8/1997 | Murakami | 134/80 |
| 5,666,985 | | 9/1997 | Smith, Jr. et al. | 134/142 |
| 5,951,763 | | 9/1999 | Knox | 118/409 |

FOREIGN PATENT DOCUMENTS

| | | | | |
|---|---|---|---|---|
| 683818 | * | 9/1979 | (SU) | 134/140 |

* cited by examiner

*Primary Examiner*—Philip R. Coe
(74) *Attorney, Agent, or Firm*—Olson & Hierl, Ltd.

(57) ABSTRACT

Drive mechanism suitable for a parts treating machine comprises a housing defining a chamber containing a rotatable carriage wheel with a fixture journalled for rotation thereon. A carriage wheel drive is provided for indexing the carriage wheel and a fixture drive for rotating fixtures carried by the carriage wheel at a predetermined position. The carriage wheel drive includes a motor and a gear reducer operatively connected to the carriage wheel. The fixture drive includes a motor and a gear reducer operatively connected to a gear on a shaft extending upwardly from the fixture by an endless belt. The carriage wheel may be moved from a load station to a treating station, where spray nozzles or the like may spray treating material onto the parts to be treated as they are rotated together with the fixture at the treating station. Thereafter, the carriage wheel is indexed to move the fixture to an optional blow-off station, where blow-off nozzles can blow air against the parts to remove treating material and to dry the treated parts, and subsequently to return the fixture to a load station where the treated parts can be removed from the fixture and parts to be treated can be placed into the fixture to begin the next cycle of operation. The carriage wheel and the fixture can be driven either by a single motor or by separate motors, as desired.

16 Claims, 5 Drawing Sheets

PARTS TRANSPORT MECHANISM FOR A ROTARY STYLE PARTS TREATING MACHINE

FIELD OF THE INVENTION

This invention relates generally to a parts transport mechanism suitable for a compact, multi-stage, rotary style parts treating machine. The mechanism includes a carriage wheel rotatable about a generally vertical axis and at least one rotatable fixture on the carriage wheel intermittently rotatable about a generally vertical axis spaced from the rotational axis of the carriage wheel.

BACKGROUND OF THE INVENTION

Various types of parts treating machines are known. U.S. Pat. No. 3,645,791 to Sadwith shows a parts cleaning machine that includes a platform rotatable in a housing, with parts to be cleaned supported on the platform and with a plurality of nozzles positioned in the housing for spraying streams of water on the articles to produce a scrubbing, scouring, or lifting effect on dirt and foreign matter present on the articles or parts being washed. Since the parts to be cleaned are stationary on the platform, cleaning of irregular shaped parts is sometimes difficult and a relatively large number of spray nozzles and a relatively large volume of cleaning solution or wash solution is need to try to reach and clean all surfaces of the parts to be cleaned.

U.S. Pat. No. 5,197,500 to Diamond shows a combustion chamber cleaning machine including a revolvable main turntable having a plurality of individual minor turntables for supporting the combustion cylinders and rotating them. The drives and controls for the main turntable and the minor turntables are relatively complex and costly.

U.S. Pat. No. 5,666,985 to Smith shows a programmable apparatus for cleaning semiconductor parts which includes a chuck mounted on a rotation mechanism rotatable around a first axis and the element to be cleaned rotates around a second axis spaced from the first axis in a planetary member. The drives for the main turntable and the minor turntables are subject to contamination because of their location in the cleaning chamber.

In multi-stage rotary washers, parts are transported along a circular path. After a part is loaded in the housing of the rotary washer, the parts transfer mechanism indexes the part into the first station of the rotary washer. Each successive index transports the part to the next station. Eventually, after passing through each of the processing stages, the part arrives at the unload station, where it is removed from the rotary washer. The transfer mechanism rotates about a single axis. Because of this, spray and blow-off nozzles, which are used to clean, rinse and dry, respectively, have to be positioned in numerous locations throughout the processing stages.

The known multi-stage rotary washers have several drawbacks. The equipment footprint is large, that is, the rotary washer occupies considerable floor space, and the parts transport mechanisms are complex.

The present invention provides an improved parts transfer mechanism which obviates deficiencies and disadvantages of prior art parts treating machines.

Other objects and advantages of the present invention will be made more apparent in the description which follows.

SUMMARY OF THE INVENTION

A parts transport mechanism for a rotary parts treating machine includes a carriage wheel on a generally vertically oriented shaft journalled for rotation in a housing, at least one fixture carried by the carriage wheel and adapted to support at least one part to be treated, a carriage wheel drive for rotating the carriage wheel, and a fixture drive intermittently engageable with the fixture to rotate the fixture about its own axis. The carriage wheel is situated in a housing that defines a treatment chamber having an inlet opening and a plurality of stations, including a load station. The carriage wheel drive rotates the carriage wheel to transport a fixture from station to station, and the fixture drive rotates the fixture at a station other than the load station.

The fixture may comprise a foraminous or wire mesh basket for holding parts to be treated, for example, washed, or a support such as a hook for retaining a part to be painted or cleaned by an abrasive material.

BRIEF DESCRIPTION OF THE DRAWINGS

In the present drawings, like numerals in the various views refer to like elements.

DESCRIPTION OF THE PREFERRED EMBODIMENT

Figure 1:
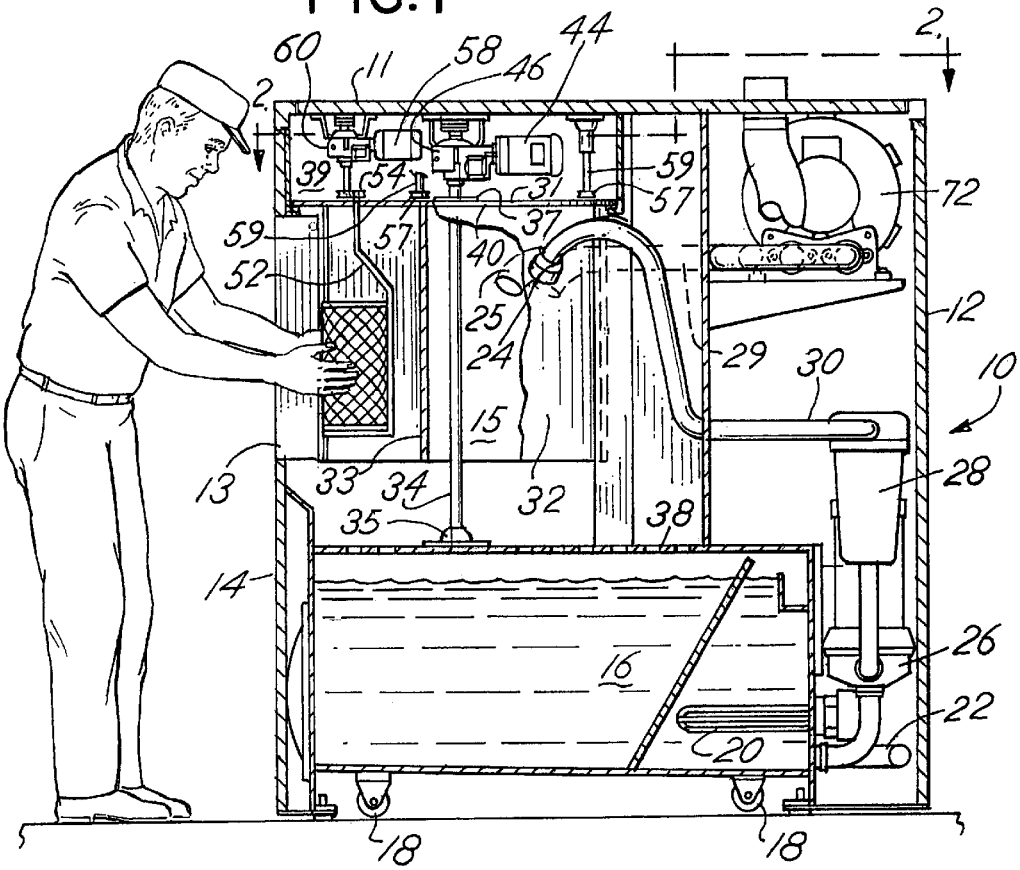
FIG. 1 is an elevation view, in section, of a parts treating machine embodying the transport mechanism of the present invention.
Figure 2:
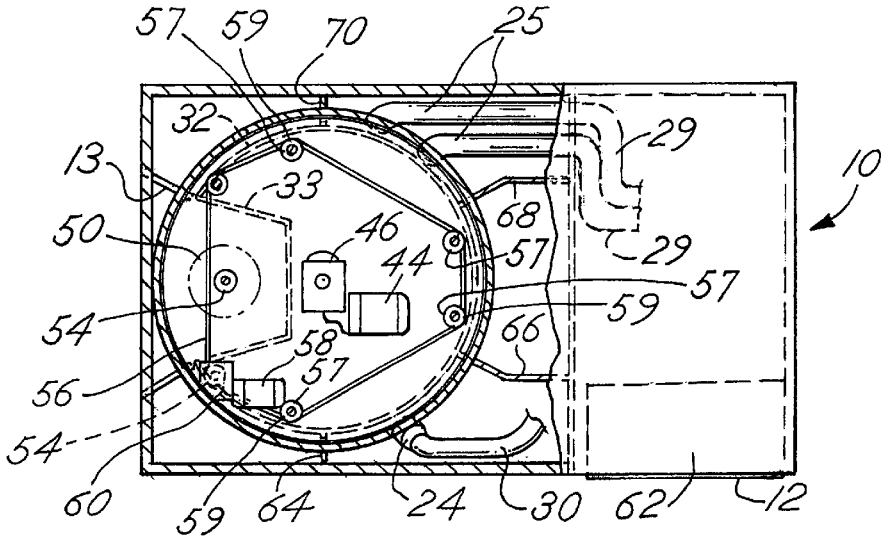
FIG. 2 is a plan view of the parts treating machine of FIG. 1 and taken along plane 2—2 to show an illustrative arrangement of drive components.

FIGS. 1 and 2 show a parts treating machine 10 equipped with a parts transport mechanism of the present invention. The parts treating machine 10 comprises a housing 12 which defines a cleaning chamber and contains the operating components. The parts treating machine utilizing the present parts transport mechanism may be used for a variety of purposes including, but not limited to, parts cleaning, paint spraying, ultraviolet radiation curing, abrasive cleaning, and the like procedures.

A carriage wheel 32 is positioned in the housing 12. The carriage wheel 32, which may be provided with one or more optional pockets 33 that depend from top plate 31, is carried on shaft 34 journalled in housing 12 for rotation about a generally vertical axis. The carriage wheel 32 is accessible through the inlet opening 13 in the housing 12. The shaft 34 is carried in a bearing 35 at its lower end on support 38 in housing 12. At its upper end the shaft 34 is journalled in a bearing 37 on top plate 31 of the carriage wheel 32. The carriage wheel 32 is rotated by a carriage wheel drive, which in the embodiment shown in FIG. 2 utilizes an electric drive motor 44 connected to a shaft 34 via a gear reducer 46. Other types of motors, for example, hydraulic, pneumatic, and the like can be utilized as well. The top plate 31 cooperates with the housing 12 to define a drive compartment 39 above treatment chamber 15.

Rotatably carried on the carriage wheel 32 and within the pocket 33 is a downwardly depending fixture 50, which in the shown embodiment is a foraminous or wire mesh basket for holding parts to be treated. The fixture 50 comprised of a foraminous basket is employed when it is desired to wash the parts. For painting or for certain other cleaning or parts treating purposes, the fixture 50 may comprise a base having a clamp or like holder for the part to be treated, for example, painted or cleaned by a fluidized abrasive under air pressure. The fixture 50 is carried in the pocket 33 on a bearing for rotation about a generally vertical axis which is offset from the generally vertical axis of the carriage wheel 32. The fixture 50 is moved from the loading position shown in FIG. 2 to a treating position proximate to the spray nozzles 24 and then to a blow-off position proximate the blow-off nozzles 25. At the treating station, the fixture 50 is rotated about a generally vertical axis spaced from the rotational axis of shaft 34 in order to facilitate the cleaning of the parts in the foraminous basket or the painting, or other treatment of the part on the fixture. The fixture 50 includes a shaft 52 which is driven rotatably by a fixture drive which includes a drive gear 54 on the shaft 52, a driven endless chain, band, or belt 56 which is adapted to engage the gear 54, and a drive motor 58 connected to the shaft 52 via a gear reducer 60. The drive motor 58 will drive the endless belt 56 via the gear reducer 60 and the associated gear 54. The drive motor can be an electric motor, hydraulic motor, pneumatic motor, and the like.

As seen in the embodiment of FIG. 2, the endless belt 56 is trained over five idler gears 57 carried on shafts 59 depending from and secured to the top 11 of the housing 12 in order to desirably position the belt 56 for selective, intermittent engagement with drive gear 54. At the blow-off station, the fixture 50 is rotated to facilitate removal of the wash solution from the parts to be washed or contamination resulting from an abrasive cleaning.

The drive mechanisms in drive compartment 39 are separated from the treating materials and contaminants in the parts treating chamber 15 defined in the housing below the top plate 31. Preferably, the top plate 31 is part of the carriage wheel 32 and is rotated together with the carriage wheel 32. The drive motor 44 for the carriage wheel drive and the drive motor 58 for the fixture drive preferably are mounted to the top of the housing 11. The carriage wheel drive and the fixture drive can be actuated by separate motors, as shown in FIG. 2, or by a single motor, as desired.

For parts washing purposes, positioned in the bottom of the housing 12 and accessible through an access door 14 in the housing 12 is a tank 16 for a treating fluid, which can be a wash solution, paint, or compressed air for a fluidized abrasive material borne by air under pressure. In order to heat the contents of the tank 16, if needed or desired, a heater 20 is provided.

Spray nozzles 24 in the housing 12 are operatively connected to the tank 16 via pump 26, filter 28 and conduit 30. At the rear, the housing 12 is provided with a hinged access door to facilitate cleaning or change out of the filter 28.

For ease of transport, the machine 10 may be on casters or wheels 18.

Situated within a control panel 62 are suitable controls for controlling the carriage wheel drive so as to turn or index the carriage wheel 32 from station to station, and for controlling the fixture drive to rotate the fixture within the cell or pocket 33 in the carriage wheel 32.

Partitions 64, 66, 68, and 70 can be provided in housing 12 in order to divide the interior of the housing 12 into operating zones or stations where various treating activities take place. The partitions 64 and 66 define the initial treating station, where the washing or the painting of the parts takes place. Partitions 68 and 70 define a blow-off station where liquid or particles are removed from the cleaned parts, and drying of the part or parts may occur. The blower 72 in the housing 12 is operatively connected to the blow-off nozzles 25 in the blow-off station via suitable conduit 29 in the housing 12. Air from the blower 72 is discharged under pressure from the nozzles 25 and forces liquid or particles from the surfaces of the cleaned parts to aid in drying the cleaned parts. Other treatment stations can be provided as well, for example, for applying a corrosion inhibitor onto the cleaned parts.

With reference to FIG. 2, the fixture 50 is accessible through the inlet opening 13. The embodiment shown in FIGS. 1 and 2 includes only a single fixture 50 on the carriage wheel 32; however, any number of fixtures can be carried on the carriage wheel, depending on its size. The endless belt 56 will be driven by the drive motor 58 via the gear reducer 60 and the gear 54 associated therewith. At the load position, the gear 54 on the shaft 52 is not engaged with the endless belt 56. The carriage wheel 32 is actuated by the carriage wheel drive, and the fixture 50 is moved from the load station to a preselected station or position proximate the spray nozzles 24. At this location, the gear 54, which may be a spur gear, is engaged with the endless chain, band or belt 56, driven by the fixture drive, to rotate the fixture 50 about its axis. Thus, at the initial treatment station, which may be for example, a wash station, between the partitions 64 and 66, the fixture 50 is rotated about its axis. The gear 54 is also operatively engaged with the endless belt 56 while the fixture 50 is in the blow-off station, so that the fixture 50 is rotated. Inasmuch as drive gear 54 does not engage the belt 56 when the fixture 50 is at the load station, the fixture 50 is not rotating when it is in the load and/or unload position.

Because the parts to be treated are rotating within the confines of a pocket 33 of the carriage wheel 32, the number of spray nozzles 24 and blow off nozzles 25 can be reduced significantly in a cleaning embodiment of the invention. It will be understood, however, that though a single spray nozzle 24 and a single blow-off nozzle 25 is shown in FIG. 2, each of these nozzles may be an array suitably arranged to maximize the spray of treating solution or treating material and air, respectively. The unique arrangement of the components of the parts transport mechanism of the present invention has considerable impact upon the resulting parts treating machine, namely, the machine can be more compact, the pumps for liquids and the blower for air can be smaller, thereby reducing horsepower requirements and kilowatt usage. The liquid tanks or reservoirs also can be smaller, reducing the overall footprint or floor space required. The net effect is a compact parts treating machine with appreciably reduced operating costs. The same is true if the parts treating machine were used for applications other than parts cleaning, for example, paint spraying. Overall, the present parts transport mechanism having a carriage wheel and the drives associated therewith affords a considerable advantage over existing parts treating equipment.

Figure 3:
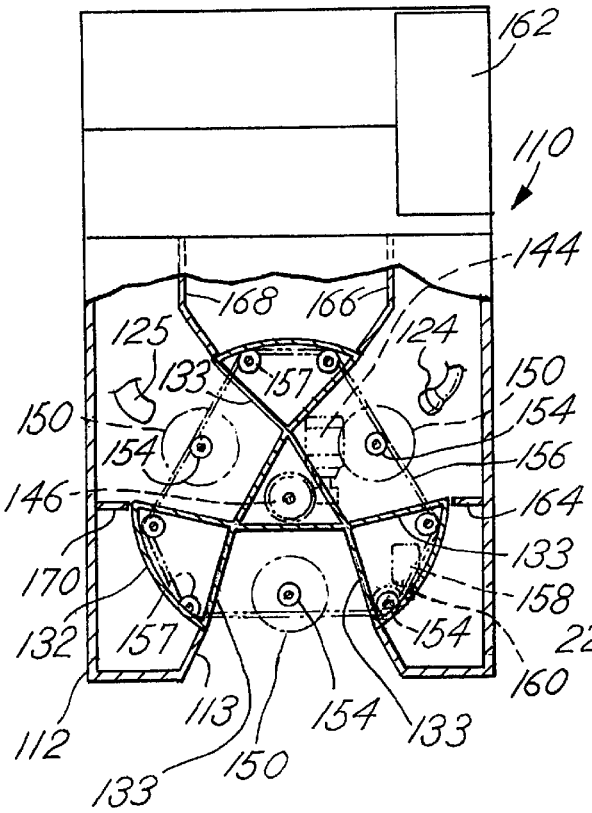
FIG. 3 is a plan view of the parts treating machine similar to FIG. 2 but illustrating a modified parts treating machine having a carriage wheel carrying three fixtures.

A modified parts treating machine 110 is shown in FIG. 3. Machine 110 includes a carriage wheel 132 with three optional pockets 133, and having a fixture 150 in each pocket. The housing 112 is constructed and the components thereof are arranged basically in the same manner as the housing 12 discussed hereinabove. The modified parts treating machine 100 operates much the same as the parts treating machine 10, except that capacity is increased through the use of three fixtures on the carriage wheel rather than one.

The drive mechanism for the machine 110 is substantially the same as that previously described, except that five idler gears 157 are employed to define fixture drive gear engagement regions. The spur gears 154 on the fixtures 150 are engaged with the endless chain or belt 156 at the first treating station and at the blow-off station, so as to rotate the fixtures 150 when positioned at these locations. The spur gear 154 is disengaged from the chain 156 when the carriage wheel 132 is indexed with a fixture 150 at the loading station. Hence, the fixture 150 at the loading station will not be rotated while fixtures at other stations around the carriage wheel are rotated. The spur drive gear 154 can also be disengaged while the pocketed wheel 132 is indexed from station to station.

Initially, parts to be treated can be loaded into the fixture 150 on the wheel 132 aligned with the inlet opening 113. The fixture 150 at the load station is not rotating since the spur drive gear 154 at the upper end thereof is disengaged from the endless belt 156. The controls in the control panel 162 are operated to actuate the carriage wheel drive comprising drive motor 144 and to index the carriage wheel 132 from the load station to the first treating station.

At the first treating station the spur drive gear 154 on the fixture 150 is engaged with the endless belt 156, which is driven by drive motor 158 and associated drive gear 154, and the fixture 150 is rotated so as to enhance treating of the parts. When the carriage wheel 132 is turned to present a fixture to the blow-off station, the fixture gear 154 is engaged with the endless belt 156, and the fixture 150 is rotated at the blow-off station. Air (or like drying fluid) may be blown through the spray nozzles 125 to remove any treating material present, for example, wash solution, and to dry the parts. The carriage wheel 132 is indexed to the load station, where the gear 154 is disengaged from the endless belt 156, and the fixture 150 is not rotated to enable removal of the treated parts from the fixture 150. As the carriage wheel 132 is indexed from station to station, the parts in each fixture 150 will be treated, for example, cleaned or sprayed and dried.

Figure 4:
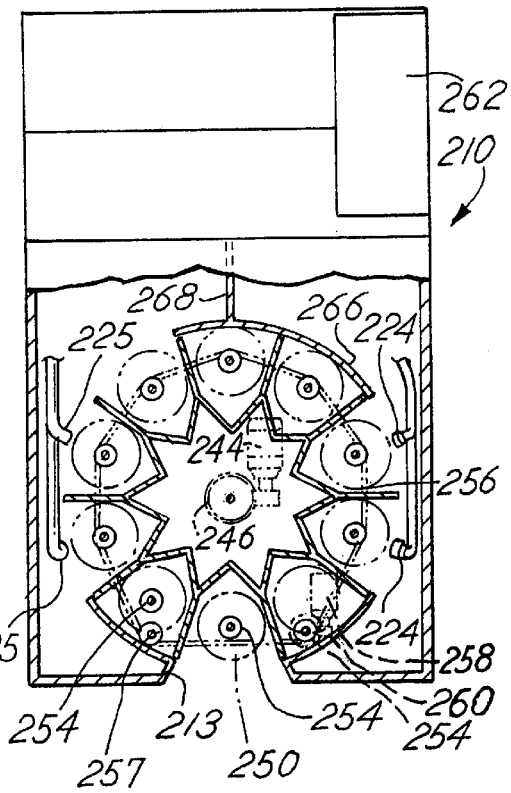
FIG. 4 is a plan view similar to FIG. 2 but illustrating a modified parts treating machine having a carriage wheel carrying ten fixtures, and including a drain position in the housing.
Figure 5:
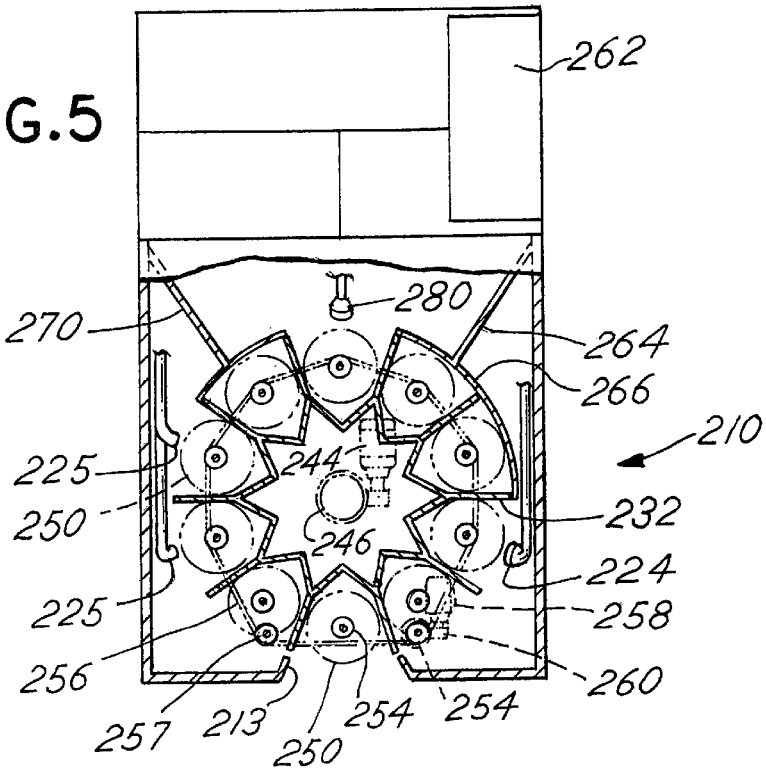
FIG. 5 is a plan view similar to FIG. 2 but illustrating a modified parts treating machine having a carriage wheel carrying ten fixtures, and including both a rinse position and a drain position.
Figure 6:
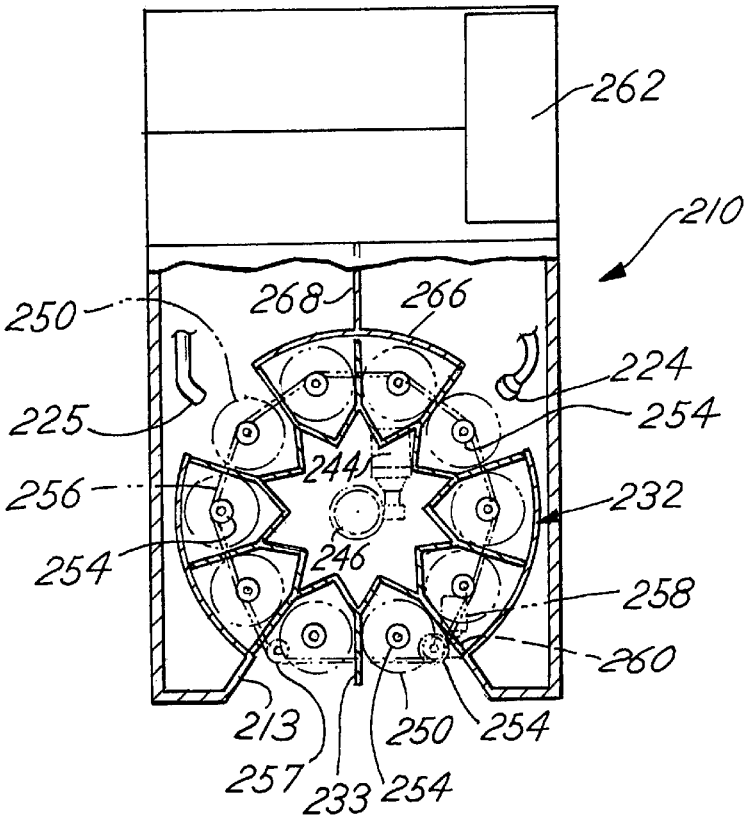
FIG. 6 is a plan view similar to FIG. 2 but illustrating a modified parts treating machine having a widened inlet opening in the housing to accommodate both a load station and an unload station.

Another embodiment of parts treating machine is shown in FIGS. 4, 5 and 6. Ten pockets are provided in the carriage wheel 232 equipped with pockets 233 and with a downwardly depending fixture 250 situated in each of the pockets. The drive mechanism is substantially the same as that previously described, except that the endless belt 256 is trained over seven fixture drive gears 254 and one idler gears 257. As shown in FIGS. 4, 5 and 6, three fixtures 250 are disengaged from the belt 256 at any given point in time and seven fixtures are driven by the belt 256 at their respective stations. The belt 256 is driven by fixture drive motor 258, gear reducer 260, and associated drive gear 254. A belt tensioner may be used, if desired.

In the embodiment of FIG. 4, there are two arrays of spray nozzles 224 to spray treating material into two fixtures 250 at the same time. Provided in the housing 212 are removable partition walls 266 and 268. In the region of the partition wall 266 treating material can drain from the parts. One or more arrays of blow-off nozzles 225 are provided in the housing 212 to remove any material remaining on the parts after draining.

In the embodiment of FIG. 5, the partitions 264 and 270 are arranged somewhat differently from the partitions in the embodiment of FIG. 4 and a rinse nozzle 280 is provided between the partitions 264 and 270. The rinse nozzle 280 may comprise an array of spray nozzles operatively connected to a tank of rinse solution in the housing 212. The single spray nozzle or array of spray nozzles 224 spray treating material, for example, wash solution, into one fixture at the first treating station. As the carriage wheel 232 is indexed, the fixture 250 carrying the treated parts moves from the first treating station to the next station, and the treating material still on the treated parts, for example, a wash solution, can drain from the treated parts. At the rinse station, spray nozzles 280 can spray a rinse liquid onto the treated, for example, cleaned parts. The blow-off nozzles 225 are adapted to blow off the remaining material, for example, liquid, from the cleaned parts in two cells or pockets 233 of the carriage wheel 232.

In the embodiment of FIG. 6, the inlet opening 213 in the housing 212 is widened to permit access to two adjacent cells or pockets 233 of the wheel 232, thereby providing separate load and unload stations at the same access opening. The carriage wheel 232 is indexed by the carriage wheel drive mechanism including drive motor 244 from the load station to the first treating station, for example, the wash station, where the spray nozzle 224 are positioned to spray a wash solution onto the part or parts on the fixture 250. The carriage wheel 232 is indexed to position a single fixture 250 at the blow-off station, where liquid remaining on the treated parts can be blown from the cleaned parts by spray nozzles 225. The drive mechanism in FIG. 6 is basically the same as the drive mechanism shown in FIGS. 4 and 5, except that the idler gears 257 are located so that at the load station the gears 254 of the two fixtures 250 are disengaged from the endless belt 256 and the indexing sequence is different to accomodate the shown configuration, for example, triple indexing. In this manner, the fixtures 250 at the load station do not rotate to permit loading and unloading of parts to be treated into and out of the fixtures 250. For example, parts to be treated can be loaded into the right fixture 250 at the load station as viewed in FIG. 6 and treated parts can be removed from the left fixture 250 at the load station as viewed in FIG. 6. The endless belt 256 is driven by the fixture drive motor 258, gear reducer 260, and associated drive gear 254.

Figure 7:
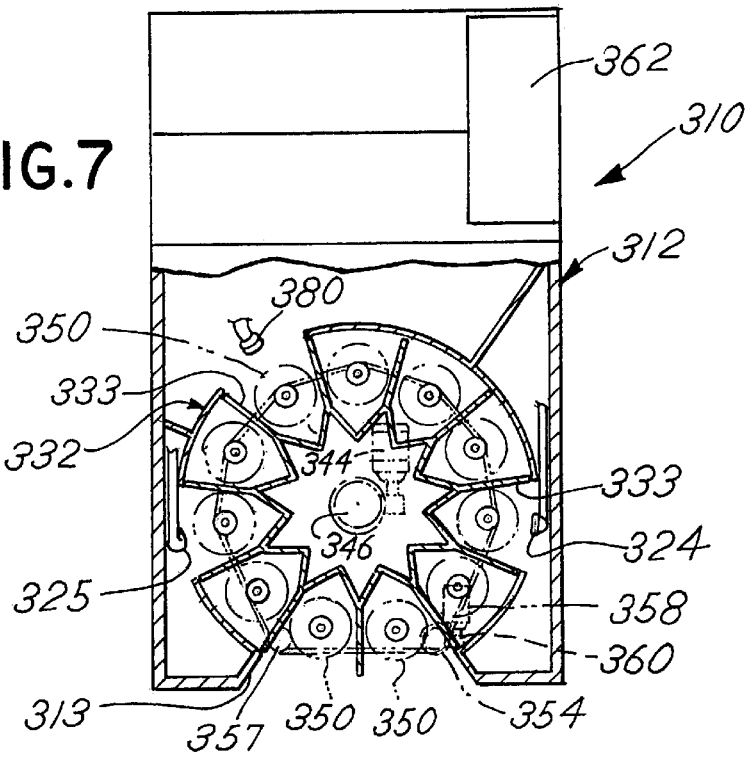
FIG. 7 is a plan view similar to FIG. 2 but illustrating a modified parts treating machine having a carriage wheel carrying eleven fixtures, with a widened inlet opening for accommodating both a load position and an unload position and including both a rinse position and a drain position in the housing.

FIG. 7 shows a modified parts treating machine 310 having eleven pockets 333 in the carriage wheel 332. The configuration is similar to the embodiment of FIG. 6 in that the inlet opening 313 in the housing 312 is widened to permit access to two fixtures 350 at the load station. As in FIG. 6, the right fixture 350 in FIG. 7 may be used to load parts to be treated while treated parts can be removed from the left fixture 350 at the unloading station. The parts treating machine 310 incorporates a first treating station, for example, a wash station, having spray nozzles 324 for spraying wash solution into a single cell or pocket 333 of the carriage wheel 332, a rinse station where spray nozzles 380 can spray rinse solution onto a single fixture 350 of the carriage wheel 332, and a blow-off station, where blow-off spray nozzles are positioned to remove liquid from the cleaned parts in or on a single fixture 350 to dry same.

The drive mechanism for the treating machine 210 with the ten pocket wheel as shown in FIG. 6 is substantially the same as the drive mechanism for the eleven pocket parts treating machine 310 of FIG. 7. A gear 354 associated with each fixture 350 is adapted to engage the endless belt 356. The idler gear 357 is positioned so that the gear 354 for the two fixtures 350 at the load station are not engaged with the endless belt 356. Thus, the two fixtures 350 at the load station are stationary while at the load station. The carriage wheel 332 is rotated by the drive motor 344 while the endless belt 356 is driven by the drive motor 358, gear reducer 360, and associated drive gear 354.

Figure 8:
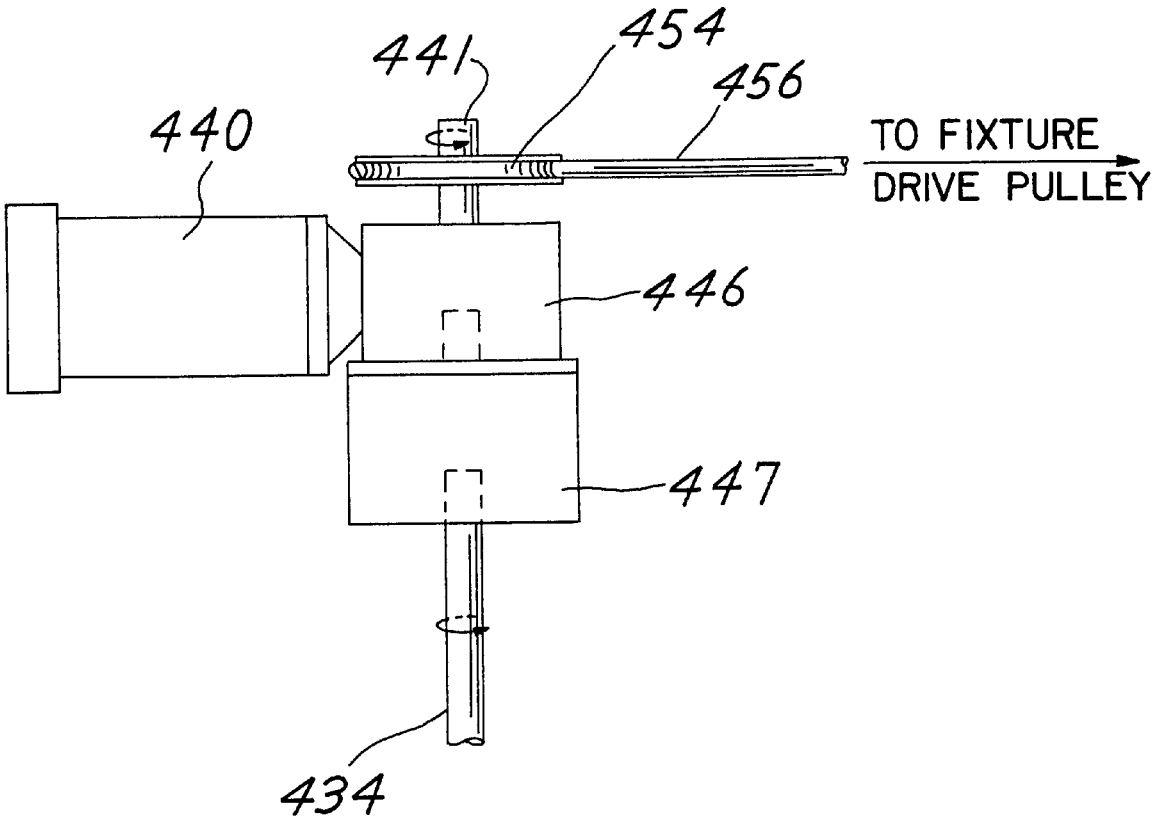
FIG. 8 is a schematic elevation view of a modified carriage wheel drive and fixture drive, wherein only a single drive motor is used.

Turning to FIG. 8, there is shown schematically a drive mechanism for the carriage drive and the fixture drive which is actuated by a single motor. The motor 440, which may be an electric motor, a hydraulic motor, a pneumatic motor, and the like, is operatively connected to a gear box 446 which drives an output shaft 441. Carried on the output shaft 441 and rotatable therewith is a gear or pulley 454 that is operatively connected to a chain or belt 456 adapted to drive the fixture or fixtures. A clutch brake 447 selectively cooperates with the gear box 446 to drive the carriage wheel. The shaft 434 is the carriage wheel shaft or is on the centerline of the carriage wheel shaft. In use, the drive motor 440 is operated continuously when the parts treating machine is operating.

The gear box 446 operates continuously to drive the gear or pulley 454 and the endless chain or belt 456 operatively connected thereto for actuating the fixture or fixtures. When the clutch brake 447 is disengaged from the gear box 446, the shaft 434 is not actuated, and the carriage wheel is not rotated. When the clutch brake 447 is engaged with the gear box 446, the shaft 434 is rotated to move the carriage wheel.

Figure 9:
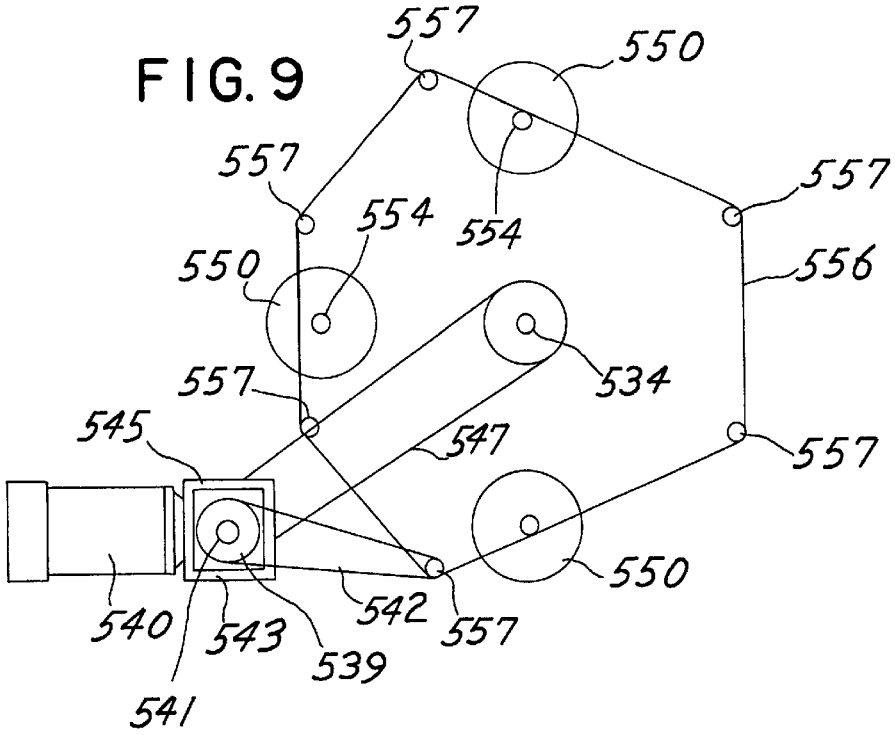
FIG. 9 is a schematic plan view of another modified carriage wheel drive and fixture drive, wherein only a single drive motor is used.
Figure 10:
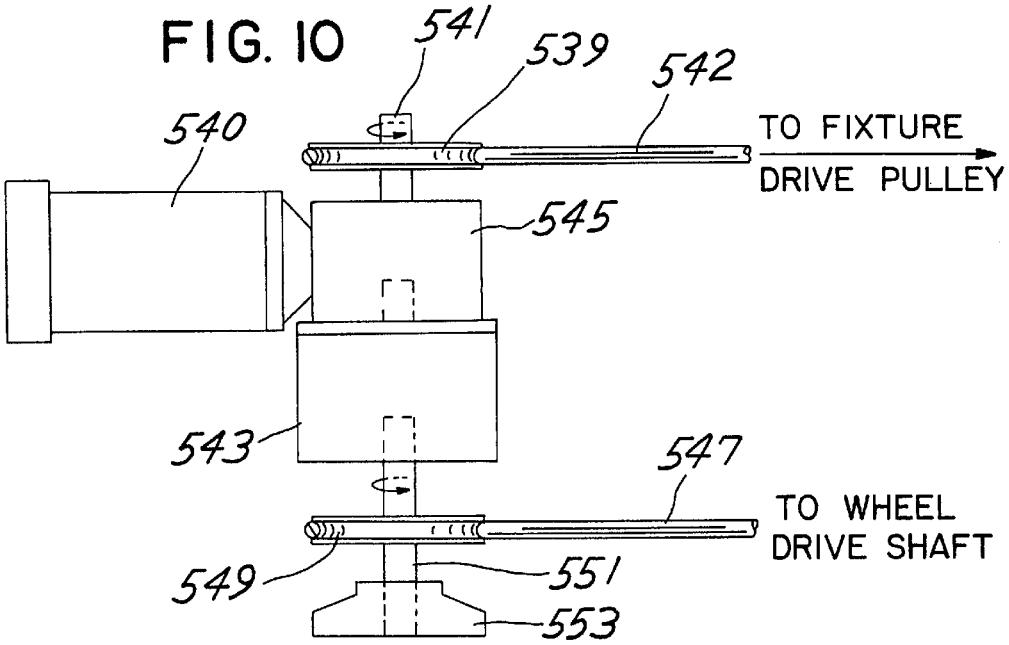
FIG. 10 is a schematic elevation view of the carriage wheel drive and fixture drive of FIG. 9.

With reference to FIGS. 9 and 10 there is shown another embodiment of a single motor drive mechanism for a parts treating machine. The drive mechanism is actuated by a drive motor 540 operatively connected to a gear box 545 which drives an output shaft 541. Carried on the output shaft 541 and rotatable therewith is a gear or pulley 539 that is operatively connected to a chain or belt 542. The endless chain or belt 542 is trained over a fixture drive gear or pulley 557 for driving the endless belt or chain 556 to rotate the fixtures 550 that are operatively engaged with the endless chain or belt 556. At the load station the gear 554 associated with the fixture 550 is not engaged with the chain or belt 556 and the fixture 550 at the load station does not rotate.

A clutch brake 543 selectively cooperates with the gear box 545 to drive the carriage wheel. The shaft 551 is operatively connected to the clutch brake 543 and is driven thereby when the clutch brake 543 is engaged with the gear box 545. The lower end of the shaft 551 may be journalled in a bearing 553 on the parts treating machine. Secured to the shaft 551 is a gear or pulley 549 which is operatively connected to a chain or belt 547 for rotating the carriage wheel drive shaft 534 and the carriage wheel carried therewith.

In use, the drive motor 540 may be operated continuously when the parts treating machine is operating. The gear box 545 operates together with the drive motor 540 to drive the gear or pulley 539 on the shaft 541 and thereby drive the chain or belt 542, which is connected to and drives the fixture drive pulley 557. Rotation of the gear 557 causes rotation of the endless belt 556 and rotation of the fixtures 550 engaged with the endless belt 556. When the clutch brake 543 is disengaged from the gear box 545, the shaft 551 will not be actuated and the carriage wheel will not be rotated. When the clutch brake 543 is engaged with the gear box 545, the shaft 551, via gear or pulley 549, drives the endless belt 547 and the wheel drive shaft 534 operatively connected thereto to rotate or index the carriage wheel.

The parts treating machine of the present invention is readily adaptable for a variety of configurations to suit the needs of selected users. The parts treating machine is compact, requires a minimum of floor space, and is relatively inexpensive to build and to operate. The drive mechanism is positioned above the treatment chamber and is separated from the contaminants in the treatment chamber. The drive mechanism may incorporate a single drive motor to drive both the carriage wheel and the fixtures or the carriage wheel drive and the fixture drive may each have a separate drive motor.

While presently preferred embodiments of the present invention have been shown and described hereinabove, it will be apparent to persons of skill in the art that the invention may be otherwise embodied without departing from the spirit and scope of the appended claims.

What is claimed is:

1. A drive mechanism for a parts treating machine and comprising a carriage wheel mounted on a generally vertically oriented shaft rotatable about a generally vertical axis, at least one fixture having a fixture drive operably associated therewith for rotation about a generally vertical axis spaced from the generally vertical axis of the shaft, a carriage wheel drive operatively associated with the shaft for rotating the carriage wheel from station to station in a treatment chamber, and the fixture drive being intermittently engageable with each fixture to rotate the same at a predetermined station.

2. A drive mechanism as in claim 1, including a control for selectively actuating the carriage wheel drive and the fixture drive.

3. A drive mechanism as in claim 1, wherein the fixture has a fixture gear at the upper end thereof and the fixture drive includes an endless belt constructed and arranged for rotating the fixture drive gear when the fixture drive gear is engaged with the endless belt, the carriage drive and the fixture drive being disposed in a compartment separate from the treatment chamber.

4. A drive mechanism as in claim 3, wherein the endless belt is trained over a plurality of idler gears which are constructed and arranged to position the endless belt for engaging and rotating the fixture at a predetermined position of the carriage wheel.

5. A drive mechanism as in claim 3, including a plurality of fixtures on the wheel, each fixture having a fixture gear at the upper end thereof, and constructed and arranged to engage the endless belt at a predetermined location so as to be driven thereby.

6. A drive mechanism as in claim 3, wherein the carriage wheel has a plurality of pockets, with a fixture in each pocket, each fixture having a fixture drive gear at the upper end thereof, each fixture drive gear being constructed and arranged to engage with the endless belt for rotating the fixtures, the fixture drive gear being disengaged from the endless belt at a predetermined location of the carriage wheel.

7. A parts transfer mechanism for a rotary parts treating machine comprising: a housing defining a treatment chamber having an inlet opening and a plurality of stations including a parts load station and at least one parts treating station; a generally vertically oriented shaft in the housing; a carriage wheel mounted to the shaft for rotation about a generally vertically oriented axis; a carriage wheel drive operably associated with the shaft; at least one fixture on the carriage wheel and rotatable about a generally vertically oriented axis spaced from the shaft, said fixture constructed and arranged to support one or more parts to be treated; and a fixture drive intermittently engageable with each fixture to rotate same at a station other than the load station.

8. A rotary parts treating machine as in claim 7, wherein the fixture drive includes a drive motor operatively connected to an endless belt constructed and arranged to drive the fixture.

9. A rotary parts treating machine as in claim 7, wherein the carriage wheel drive includes a drive motor operatively connected to the shaft for rotating the shaft to move each fixture from station to station.

10. A rotary parts treating machine as in claim 9, wherein the fixture drive and the carriage wheel drive are disposed in a compartment separate from the treatment chamber.

11. A rotary parts treating machine as in claim 7, wherein the carriage wheel drive and the fixture drive each have a separate drive motor.

12. A rotary parts treating machine as in claim 7, wherein the carriage wheel drive and the fixture drive are both actuated by the same drive motor.

13. A rotary parts treating machine as in claim 12, wherein a gear box is operatively associated with the drive motor, and the fixture drive includes a first endless belt operatively driven from the gear box for rotating a fixture drive pulley which is operatively engaged to a second endless belt constructed and arranged to drive the fixture.

14. A rotary parts treating machine as in claim 13, wherein a clutch brake is operatively connected to the gear box, the clutch brake being operatively connected to the vertically oriented shaft, whereby, when the clutch brake is disengaged from the gear box, the vertically oriented shaft will be inoperative and when the clutch brake is engaged with the gear box, the vertically oriented shaft will be rotated to rotate the carriage wheel.

15. A rotary parts treating machine as in claim 14, wherein the clutch brake is directly connected to the vertically oriented shaft.

16. A rotary parts treating machine as in claim 14, wherein the carriage wheel drive includes a third endless belt operatively connected to the clutch brake and the vertically oriented shaft for rotating the carriage wheel when the clutch brake is engaged with the gear box.

* * * * *